United States Patent [19]

Strandli et al.

[11] 4,353,302

[45] Oct. 12, 1982

[54] ARRANGEMENT IN OR RELATING TO A PROJECTILE

[75] Inventors: Kaare R. Strandli; Arne M. Östlie, both of Raufoss, Norway

[73] Assignee: A/S Raufoss Ammunisjonsfabrikker, Raufoss, Norway

[21] Appl. No.: 147,051

[22] Filed: May 6, 1980

Related U.S. Application Data

[63] Continuation of Ser. No. 957,851, Nov. 6, 1978, abandoned, which is a continuation of Ser. No. 779,994, Mar. 22, 1977, abandoned.

[30] Foreign Application Priority Data

Jul. 1, 1976 [NO] Norway ..... 762297

[51] Int. Cl.[3] ..... F42B 11/24; F42B 13/14

[52] U.S. Cl. ..... 102/364; 102/518; 102/473

[58] Field of Search ..... 102/517–519, 102/501, 364, 365, 473

[56] References Cited

U.S. PATENT DOCUMENTS

| | | | |
|---|---|---|---|
| 740,849 | 10/1903 | Groff | 102/52 |
| 1,179,686 | 4/1916 | Van Kampen et al. | 102/52 |
| 2,564,870 | 8/1951 | Weiss | 102/52 |
| 2,724,334 | 11/1955 | Norton et al. | 102/52 |
| 3,028,808 | 4/1962 | Porter et al. | 102/364 |
| 3,096,715 | 7/1963 | Dufour | 102/52 |
| 3,677,181 | 7/1972 | Giljarhus et al. | 102/364 |
| 3,782,287 | 1/1974 | Sie | 102/52 |
| 3,890,902 | 6/1975 | Travor et al. | 102/52 |

FOREIGN PATENT DOCUMENTS

| | | | |
|---|---|---|---|
| 764833 | 5/1934 | France | 102/52 |
| 351522 | 2/1961 | Switzerland | 102/52 |

*Primary Examiner*—Harold J. Tudor
*Attorney, Agent, or Firm*—Larson and Taylor

[57] ABSTRACT

A projectile has a primary penetration element arranged at the rear end, and surrounded by a substantially tube like secondary penetration element, so that in front of the primary penetration element is formed a cavity within the secondary penetration element. The cavity contains a bursting charge or bursting and incendiary charges, ignitable by means of an ignition charge arranged in the nose of the projectile upon impingement against a target. The construction is such that the primary penetration element is positively prevented from moving forwardly into the cavity before the projectile hits a target and the secondary element is substantially fragmented. The projectile gives considerable splinter and fragmentation in lighter to medium targets, while functioning generally as a purely armor piercing projectile against heavy targets.

12 Claims, 3 Drawing Figures

ARRANGEMENT IN OR RELATING TO A PROJECTILE

Figure 1:
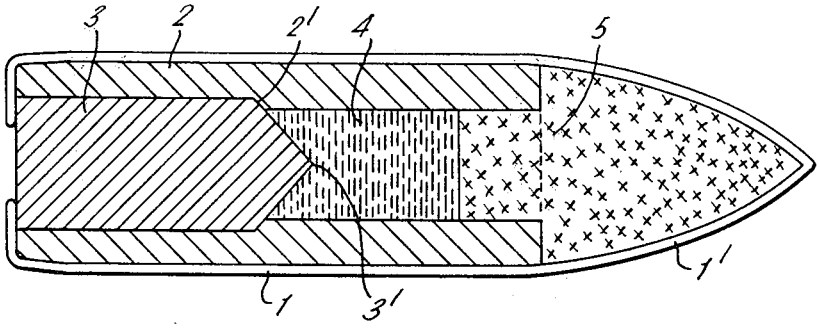

This is a continuation of application Ser. No. 957,851 filed Nov. 6, 1978, which in turn was a Rule 60 continuation of original Ser. No. 779,994 filed Mar. 22, 1977, now both abandoned.

The present invention relates to a projectile comprising a first penetration body and a second penetration body arranged around and before said first penetration body, said projectile further comprising bursting or bursting and incendiary charges as well as means for the ignition of said charges.

There are previously known a lot of proposals for the construction of projectiles which comprise various kinds of means for the ignition of a bursting and/or incendiary effect by the impingement of the projectile in a target. Thus it is known armour piercing projectiles based on a hardened steel core or a core of tungsten carbide. Such projectiles have good penetration properties in heavy as well as lighter targets. They have, however, no fragmentation effect. These projectiles are characterized in that the armour piercing body is fired with full caliber from the gun. A ballistic cap ahead of the body gives it a ballistic form. The cap can be filled with a pyro-technical incendiary charge.

The armour piercing body can also be arranged within a mantel of for instance copper, so that the body or core of the projectile has a smaller caliber than the gun.

The armour piercing body can also be arranged within a sleeve having caliber diameter and provided with a driving band. Said sleeve can consist of aluminum or steel. If aluminium is used this is due to the fact that one desires a greatest possible weight of the core, which should be able to penetrate the target.

Such an armour piercing core can also be arranged in a light metal sleeve, for instance aluminium, or a light metal cover which again is pressed into a projectile mantel. The object of the light metal cover is to save weight, so that the core, which can be made from for instance tungsten carbide, can have as high weight as possible.

All the projectile tubes disclosed above are in their function characterized in that only the armour piercing core or body penetrates a heavy target. Incendiary effect can be obtained, but no bursting or fragmentation effect is obtained behind the target. Against a light target the whole projectile will pass through without being splintered due to fragmentation effect. The only splinter effect which can be obtained is in case the separate parts of the projectile fall apart. These parts will, however, have small effect as splinter or fragments, because they are flung in the same direction as the armour piercing core and they therefore will not damage the target substantially more than what is obtained by the penetration of the armour piercing body.

There are previously also known bursting-incendiary projectiles based on a construction where the charge is situated in a sleeve or mantel which is provided with a fuse being arranged in the nose of said sleeve. Such projectiles have a good splinter, incendiary and bursting effect when hitting lighter and partly also medium heavy targets, but against heavy armoured targets they give, however, a poor effect, said sleeve not being so arranged that it penetrates the target.

The present invention has for its object to provide a projectile which gives considerable splinter, fragmentation and incendiary effect in lighter as well as more heavy targets at the same time as the armour piercing properties against the most heavy targets are as good as if they were a purely armour piercing projectile.

The object of the invention is obtained by a projectile arranged in accordance with what is defined in the folowing patent claims.

Figure 2:
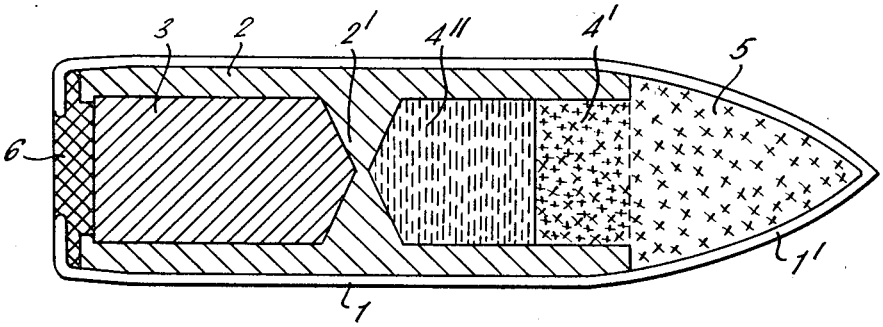
Figure 3:
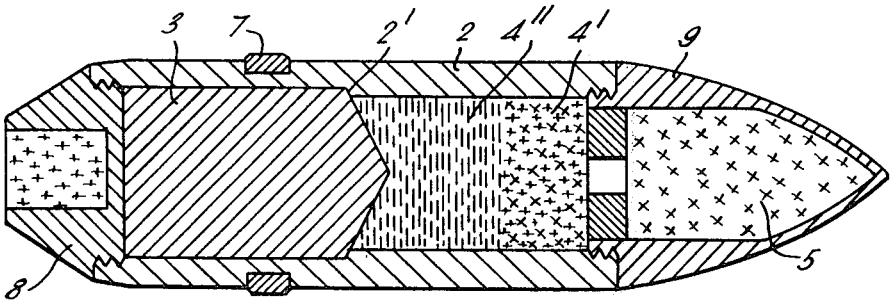

To have a better understanding of the invention, this shall now be further described under reference to some embodiments schematically disclosed in the drawing, wherein FIGS. 1, 2, and 3 show sections through different embodiments of the invention.

FIG. 1 is a section through a first embodiment of the invention. The projectile there shown consists of a mantel 1 made from copper or other convenient metal alloy. Within said mantel is placed a tubelike element 2 which in the following is called the secondary penetration element. This can be made from steel which is heat worked so that optimal piercing property as well as splinter effect is obtained when said element hits a target.

Centrally within said secondary penetration element there is arranged a primary penetration element 3. This is preferably made from a heavy metal alloy, for instance tungsten carbide with high solidity. Alternatively it can consist of a high-alloy steel, but also common steel which is heat treated to high hardness can be actual. In the nose 1' of the projectile it is located an ignition charge 5 which extends partly into the central bore of the secondary penetration element. Behind said ignition charge there is a bursting charge 4. Both said charges can be arranged also as incendiary charges. The ignition charge can if desired be separated from the charge in said bore by means of a safety mechanism, a supporting disc provided with holes or the like. The ignition charge consists in the example shown of a suitable pyro-technical mixture which is ignited when the nose part of the projectile is violently clinched.

The mode of operation of the projectile according to the described example is as follows:

By impinging a light target, for instance in the lighter part of an aeroplane, the nose of the projectile will be clinched and the ignition charge will be ignited. Before the charge in the bore of the secondary penetration element explodes the entire projectile will, however, have pierced the target inside, which charge then after this delay will explode and splinter or fragment the secondary penetration element as well as the mantel. The primary penetration element continues further into the target with great piercing effect.

When the projectile hits a more heavy target, for instance a medium heavy steel ship plate, the ignition charge will be ignited by the violent clinching of the nose. By means of a combined incendiary and bursting effect in the bore of the secondary penetration element where an incendiary charge may be arranged between the bursting charge and the ignition charge, is however, obtained that the secondary penetration element penetrates the target plate before the bursting charge splinter said element. The mantel which is of a weak material will usually not penetrate such a type of target, but will be pealed off on the outside of the plate.

When hitting a heavy target, for instance an armoured car or tank or a heavy steel ship plate, the secondary penetration element has, however, a considerable penetration effect in the same magnitude as what can be obtained by usual armour piercing projectiles.

A given specific embodiment of the present invention will of course be designed and constructed so as to accomplish the above described objectives with respect to the above described type of targets. In this sense, the type of target wall which it is desired to have the present invention penetrate prior to detonation of the bursting charge will be known and is in this sense "predetermined". Such thickness will be referred to for convenience as the "predetermined thickness".

As will be understood from what here is shown and described a projectile according to the invention will have the desired properties. At the same time as the projectile gives fully normal splinter, incendiary and fragmentation effect within a light and medium heavy target, the projectile has a corresponding armour piercing property when hitting a heavy target.

Against targets consisting of a series of plates and target components arranged behind each other, a projectile according to the invention has considerable advantages both compared with the armour piercing and the splintering/incendiary projectile. An air target is characteristic in that way. The projectile will when hitting, be splintered after having penetrated the first plate. The splintering effect from the penetration of the secondary element will be substantial against those plates or components being located behind the first plate. In addition, thereto the primary penetration element will penetrate further through the target and can thereby damage those parts which are well protected. Thereby an action is obtained being a combined splintering, incendiary and fragmentation effect from a bursting/incendiary projectile immediately after the penetration, and then one will have a great penetration property in the depth due to the secondary penetration element similar to what is obtained by armour piercing projectiles.

The structural solution of the inventive idea can be modified in many ways. The secondary penetration element need for instance not to be made from steel. It can also be made from titanium, zirconium or similar pyrofore metals. The object of using such metals is that at the same time as the penetration property for the secondary element is approximately maintained against the medium heavy target and the fragmentation effect is maintained, the splinters from the secondary element entirely or partly will be ignited due to the energy developed by the decomposition of the ignition charge and the charge in the bore. The heat generated due to the penetrated force itself will also result in ignition of the splinter from the secondary penetration element. Against for instance an air target such structural solution will cause considerable advantages as to incendiary effect without reducing the other properties of the projectile. A drawback with such splinters will be that they are lighter than steel fragments and thereby have less penetration force. The weight saved from the secondary penetration element, can, however, be used to make the primary penetration element heavier, thereby increasing the penetration property in the depth or against heavier, armoured targets. This constructive weighing out is, however, dependent on for which weapon the projectile should be used and which targets the weapon is used against.

In the following should be described some further examples of how the invention constructively can be used.

In FIG. 2 is shown a projectile with somewhat modified structural details compared with FIG. 1. The mantel 1, the primary element 3 and the ignition charge 5 in the nose 1' of the projectile is substantially unaltered, but the secondary penetration element 2 is not provided with a through-going bore, so that the partition wall 2' is formed between the primary element 3 and the charge. A lead tightening 6 is arranged at the rear end of the projectile. The charge in the foremost part of the bore of the secondary element is an incendiary charge 4' followed by a bursting charge 4''.

FIG. 3 shows an embodiment where the outer mantel is omitted and the secondary element is adapted to the caliber of the gun and is provided with driving band 7. The projectile has an end plug 8 provided with tracer material. The nose comprises an ignition charge 5 arranged in a ballistic casing 9. The charge consists of an incendiary charge 4' followed by a bursting charge 4''.

It is important that the primary element is aranged so that its foremost end 3' cannot enter into the bursting charge 4'' during handling of the projectile or by its firing. This can be safeguarded in many ways.

Preferably, a projection of the secondary penetration element located forward of the rear end thereof will extend inwardly to firmly engage the primary penetration element.

In the embodiments according to FIGS. 1 and 3 the bore through the secondary element has a somewhat larger diameter for that part taking up the primary element than for the charge. Thereby is obtained a circumferential shoulder 2' which keeps the element 3 in place. In FIG. 2 is the bore as mentioned not throughgoing. A similar locking can be obtained by providing the bore with threads which forms separation between the primary element and the charge. Such locking action can also be obtained by providing under high pressure a body of metal powder or an incendiary batch which is insensitive against impacts. As such metal powder can for instance be used zirconium or aluminium. Use of an incendiary batch as well as a batching of metal powder will contribute to increasement of the incendiary action of the projectile.

A series of further modifications are for an expert easily conceivable within the scope of the invention as this is stated in the following claims.

We claim:

1. A multi-capability projectile providing substantially splinter, fragmentation and incendiary effect after penetration of a target wall of a predetermined thickness in combination with substantial armor piercing properties, comprising a primary penetration element and a secondary penetration element, said primary penetration element being located toward the rear of the projectile and surrounded over its full length by said secondary penetration element such that said primary penetration element is disposed completely inside said secondary penetration element, the secondary penetration element being substantially longer than said primary penetration element and extending substantially beyond said primary penetration element toward the front of the projectile so as to define a cavity in the secondary penetration element forward of the primary penetration element, the secondary penetration element terminating at its forward end rearward of the front end of the projectile, bursting charge means located in said cavity no farther forward than the front end of the secondary penetration element, means defining a nose at the forward end of the projectile, forward of the secondary penetration element, an incendiary charge located in said nose for igniting upon deformation of the nose upon impacting a target, and hence for igniting said bursting charge, said nose being substantially completely filled with said incendiary charge, and hence being devoid of mechanical fuses or firing pins, said incendiary charge being constructed to burn at at rate which will delay detonation of the bursting charge until the bursting charge and its surrounding portion of the secondary penetration element have essentially passed through said wall, whereby detonation of the bursting charge, and hence splintering and fragmentation of the secondary penetration element occurs past said wall, and retaining means located forward of the rear end of the secondary penetration element for retaining said primary penetration element substantially immobile relative to said secondary penetration element prior to impact of the projectile with a target, said retaining means including a projecting surface which projects inwardly from said secondary penetration element to securely engage the primary penetration element.

2. A projectile as claimed in claim 1 wherein said secondary penetration element is formed of steel.

3. A projectile as claimed in claim 1 wherein said primary penetration element is of substantially uniform diameter over the great majority of its length.

4. A projectile as claimed in claim 1 wherein said secondary penetration element is formed of steel and terminates short of the nose of said projectile, and said nose is formed of a softer metal.

5. A projectile according to claim 1 wherein said primary and secondary penetration elements and said charges are surrounded by a projectile mantel of soft metal such as copper.

6. A projectile as claimed in claim 1 wherein said means for retaining said primary penetration element comprises a shoulder in the bore of said secondary penetration element defined by a change in diameter, such that said primary penetration element abuts against said shoulder.

7. A projectile as claimed in claim 1 including radially extending, axially facing, and abutting surface portions formed in the bore of said secondary element and the surface of said primary element for positively preventing forward movement of said primary element into said cavity until said secondary element is substantially fragmented.

8. A projectile as claimed in claim 1 wherein said means for retaining said primary penetration element substantially immobile relative to said secondary penetration element comprises interfering surface engagement between part of the surface of said primary penetration element and part of the interior surface of said secondary penetration element.

9. A projectile as claimed in claim 1, said retaining means comprising a partition portion of the secondary penetration element extending completely across its cavity so as to close off the cavity, the forward end of said primary penetration element abutting against said partition.

10. A projectile as claimed in claim 1, wherein the rear end of the secondary penetration element is formed as an end closure for said projectile.

11. A projectile as claimed in claim 1, including an end closure element attached to the rear end of the secondary penetration element to form an end closure for said projectile.

12. A projectile as claimed in claim 1, wherein the secondary penetration element forms the exterior of the projectile.

* * * * *